US007700046B2

(12) United States Patent
Goldenberg

(10) Patent No.: US 7,700,046 B2
(45) Date of Patent: Apr. 20, 2010

(54) CONTROLLED ADDITIVE/REACTANT DELIVERY SYSTEM

(76) Inventor: Alec S. Goldenberg, 157 E. 32nd St., Second Floor, New York, NY (US) 10016

( * ) Notice: Subject to any disclaimer, the term of this patent is extended or adjusted under 35 U.S.C. 154(b) by 1176 days.

(21) Appl. No.: 10/940,339

(22) Filed: Sep. 14, 2004

(65) Prior Publication Data

US 2006/0057033 A1 Mar. 16, 2006

(51) Int. Cl.
*B01L 3/02* (2006.01)

(52) U.S. Cl. ..... 422/100; 422/99; 422/102; 435/287.3; 435/288.1; 604/198

(58) Field of Classification Search ..... 422/99, 422/100, 102; 435/287.3, 288.1; 604/198
See application file for complete search history.

(56) References Cited

U.S. PATENT DOCUMENTS 3,730,235 A * 5/1973 Lewis ..... 141/172
3,875,012 A * 4/1975 Dorn et al. ..... 435/243
5,084,021 A * 1/1992 Baldwin ..... 604/131
5,439,450 A * 8/1995 Haedt ..... 604/198

* cited by examiner

*Primary Examiner*—Lyle A Alexander
*Assistant Examiner*—Dennis M White
(74) *Attorney, Agent, or Firm*—Leason Ellis LLP

(57) ABSTRACT

A system for controlled delivery of a predetermined volume of an additive (e.g., a liquid, solid, etc.) to a vacuum sealed container is provided and includes a delivery device that includes a housing having a chamber defined therein for holding the predetermined volume of additive and a piston or the like that is axially moveable within the chamber. The system includes a connector that is detachably connected to or formed as integral part of the delivery device. The connector has a hollow piercing element for piercing through a stopper of the vacuum sealed container. The attached apparatus and connector are mated with the vacuum sealed tube for delivering the additive such that the piercing element pierces through the stopper and one end of the element is in fluid communication with an interior of the container causing the chamber in the apparatus to be exposed to the vacuum resulting in the predetermined volume of additive being drawn from chamber through the connector and into the container without releasing a vacuum seal that exists between the stopper and container.

21 Claims, 3 Drawing Sheets

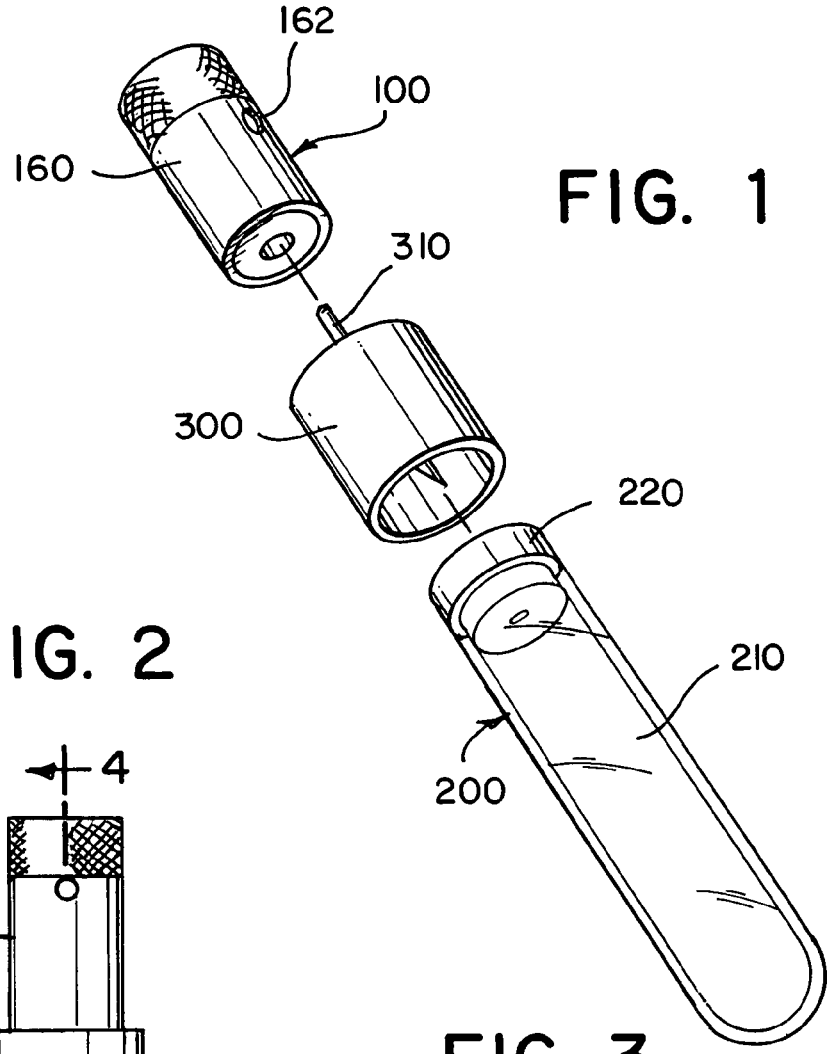
FIG. 1
FIG. 2
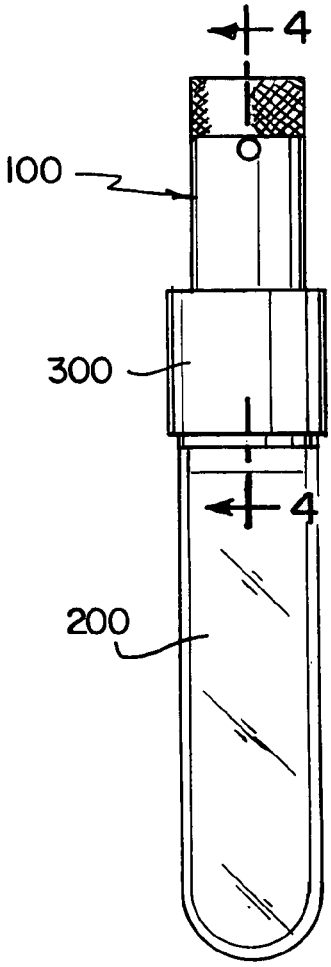
FIG. 3
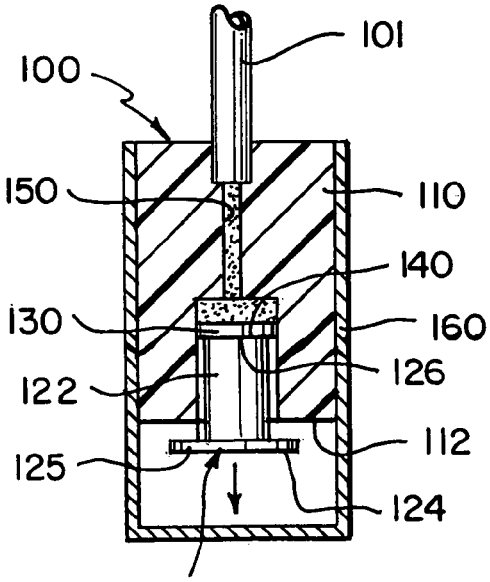

CONTROLLED ADDITIVE/REACTANT DELIVERY SYSTEM

TECHNICAL FIELD

The present invention relates to transfer systems and more particularly, relates to a controlled additive/reactant delivery device that transfers a predefined amount of reactant, such as a liquid, to a vacuum sealed tube without releasing the vacuum and permits the addition of fluid without displacing the stopper.

BACKGROUND

Physicians commonly require blood samples to analyze blood constituents to facilitate the diagnosis of certain diseases and to monitor and follow the effects of treatments on a variety of parameters. In the past, blood samples were routinely drawn from patient's veins using needles and syringes; however, recently, blood samples are more commonly collected using a system of tubes that retains a vacuum and draws a specified amount of blood into them when connected to an intravenous line. The vacuum is maintained within the tube by the means of rubber stopper or the like. A needle attached to a syringe or another retaining device can be pushed through the rubber stopper to allow the vacuum to draw a blood sample into the tube. The vacuum not only assists in drawing the blood sample into the tube but helps retain the stopper in the tube for safe transport of the blood sample to a laboratory or other facility.

One commercially available vacuum sealed tube system that has found widespread use is available under the trade name BD Vacutainer® Blood Collection Tube from Becton Dickinson of Franklin Lakes, N.J. These tubes are plastic tubes and may or may not contain, in the interior thereof, an additive, often an anticoagulant that needs to be mixed with the blood sample. The type of additive that is within the tube is identified by the color and/or color pattern on the rubber stopper. Thus, for any given analytic test, the correct tube is selected that contains the desired additive. A chart is available to confirm that the additive contained in the tube is proper for the desired laboratory use as well as to determine the number of inversions that is necessary to mix the blood sample with the additive. The general process is that (1) the tube with the correct additive is selected; (2) the correct amount of blood is drawn into the tube which allows the vacuum in the tube to be nearly exhausted; and (3) the tube is inverted the number of times dictated on the mixing chart for proper mixing of the blood sample and additive. It will be appreciated that the BD Vacutainer® Blood Collection Tube is merely one exemplary type of vacuum sealed container that is suitable for use with the present invention and that there are a number of other types of vacuum sealed tubes that can be used with the present invention.

In terms of blood sampling techniques, the practice of removing the rubber stopper and releasing the vacuum, filling the tube with blood and replacing the stopper is highly discouraged since the vacuum is lost, the stopper may not remain in place and blood may disperse from the tube resulting in contamination. In addition, practice guidelines within hospitals, clinics and offices require that the stopper not be removed to place additional fluid or reactants into the tube.

However, there are a number of shortcomings with this practice and with the conventional vacuum sealed tube system blood collection techniques and equipment. More specifically, there are some applications that involve collecting samples that require a different stabilizing or diluting agent.

Unfortunately, the construction of the above vacuum sealed container and the existing blood collection protocol do not permit or accommodate such need and as a result, there is a need for a system that permits collection of samples to measure the level of certain drugs in the blood where such application requires the introduction of a stabilizing agent in some cases. Under existing protocol concerning removal of the stopper, this type of application is not possible.

It is therefore desirable to provide a device that overcomes these disadvantages and permits a defined amount of fluid or other reactant material, such as a powder or gel, to be introduced into a vacuum sealed tube without releasing the vacuum.

SUMMARY

A system for controlled delivery of a predetermined volume of liquid or other reactant material, such as a powder or gel, to a vacuum sealed container is provided and includes a dilutant delivery device that includes a housing having a chamber defined therein for holding the predetermined volume of liquid or reactant material and a first connector section in selective fluid communication with the chamber via a main conduit having a reduced cross-section. The apparatus includes a piston that is axially moveable within the chamber in response to an applied force, with one end of the piston sealing against an inner surface that defines the chamber.

The system includes a connector that is detachably connected to the connector section of the apparatus. The connector has a hollow piercing element that has a first end to provide a releasable, sealed connection with the first connector section of the apparatus and a sharp second end for piercing through a stopper of the vacuum sealed container. The attached apparatus and connector are mated with the vacuum sealed tube for delivering the liquid or other reactant material such that the piercing element pierces through the stopper and the second end of the element is in fluid communication with an interior of the container causing the chamber in the apparatus to be exposed to the vacuum resulting in the predetermined volume of liquid being drawn from chamber through the connector and into the container without releasing a vacuum seal that exists between the stopper and container.

The present delivery system overcomes the above-mentioned shortcomings associated with the prior art, while at the same time achieving the following objectives: the system is compact; the system is easily integratable with existing blood collection systems; the system reliably delivers a defined quantity of fluid to each blood sample tube; the system is easily manufacturable for minimal cost; and the system can be easily and reliably filled with a defined quantity of fluid. As a result, the present invention permits the user to customize the exact dilutant (additive) that is to be delivered to the tube for mixing with blood and therefore, the user has a great deal of choices beyond the prepared additive tubes (e.g., Vacutainer®) that are commercially available.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which:

FIG. 1 is an exploded perspective view of a controlled additive/reactant delivery system according to a first embodiment;

FIG. 2 is a side elevation view of the controlled additive/reactant delivery system of FIG. 1;

FIG. 3 is a cross-sectional view of a additive/reactant delivery device of the system of FIG. 1 showing loading of the additive;

DETAILED DESCRIPTION OF PREFERRED EMBODIMENTS

Figure 4A:
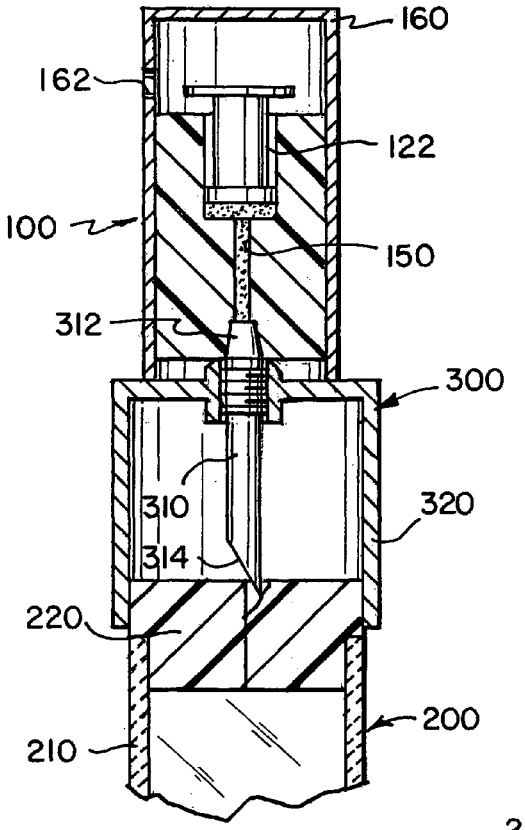
FIG. 4A is a cross-sectional view taken along the line 4-4 of FIG. 2 illustrating the mating of the delivery device to a vacuum sealed container.

Referring now to FIGS. 1-3, 4A and 4B, a controlled additive/reactant delivery system according to one embodiment is illustrated. The delivery system overcomes the above-mentioned shortcomings associated with the prior art, while at the same time achieving the following objectives: the system is compact; the system is easily integratable with existing blood collection systems; the system reliably delivers a defined quantity of fluid to each blood sample tube; the system is easily manufacturable for minimal cost; and the system can be easily and reliably filled with a defined quantity of fluid or other reactant material that is delivered to the blood collection tube is a select and controlled manner. It will be understood that the controlled delivery system is not only suitable for receiving, retaining, and then delivering a liquid reactant/additive to a collection container, but is also suitable for use with other reactant materials, such as a solid powder, a gel and other types of materials so long as they can be drawn from the delivery device under action of a vacuum, as described below. Thus, for ease of illustration, the controlled delivery system is described below as being a system that is used to delivery a liquid to the collection container; however, this is not limiting of the present invention but is merely exemplary of one application.

In FIG. 1, a blood collection tube or container 200 that is of a vacuum sealed type is illustrated and as is well known, the tube 200 includes a container body 210 for receiving and holding a fluid, such as blood, as well as a stopper 220 that mates with an open end 212 of the container body 210 in a sealed manner so as to form a vacuum within the interior of the container body 210. In one embodiment, the tube 200 can be the Vacutainer® tube that was previously described herein; however, the tube 200 can be any other type of blood collection receptacle so long as the tube 200 is adapted to maintain a vacuum therein during normal operation.

Figure 4B:
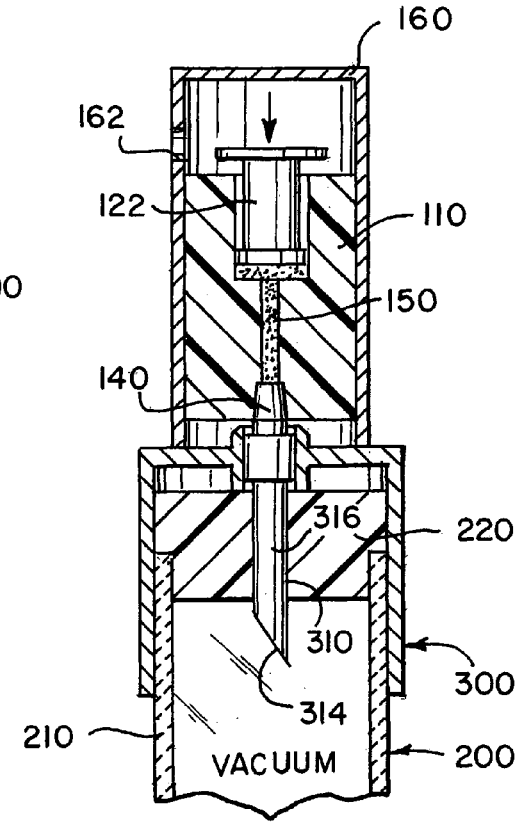
FIG. 4B is a cross-sectional view taken along the line 4-4 of FIG. 2 illustrating the piercing of the stopper of the vacuum sealed container to expose the additive to the vacuum.

As best shown in FIGS. 3, 4A, and 4B, the delivery system includes an additive/reactant delivery device 100 that includes a housing or body 110 and a complementary piston mechanism 120 that is operatively disposed within the housing 110. The exact shape of the housing 110 is not critical so long as the piston mechanism 120 can be operatively received and contained within the housing 110 and the housing 110 can contain the predefined amount of fluid that is to be discharged and delivered to the tube 200. In one embodiment, the housing 110 has a generally rectangular or cylindrical shape; however, these shapes are merely exemplary and not limiting. The housing 110 also includes and defines a chamber 130 that is formed therein and is constructed and configured to receive and hold the fluid to be delivered to the tube 200. According to one embodiment, the chamber 130 has a cylindrical shape; however, once again, this is merely one exemplary shape that the chamber 130 can have and it will be appreciated that the shape of the chamber 130 can have some other geometry.

The piston mechanism 120 is constructed to be received within the chamber 130 and therefore, it has dimensions that permit such reception into the chamber 130 while still permitting the piston mechanism 120 to move axially within the chamber 130 so as to both permit reception of fluid and apply a force to discharge the fluid. More specifically, the piston mechanism 120 includes a piston or the like 122 that has a first end 124 and an opposing second end 126, with the first end 124 being disposed proximate or closer to a top face 112 of the housing 110, while the second end 126 is closer to a bottom face 114 of the housing 110. The piston 122 slidingly travels within the chamber 130 with the liquid being sealingly contained in the chamber 130 beneath the second end 126 of the piston 122. It will be understood thus that the piston 122 serves to divide the chamber 130 into two sections, namely a first section that does not contain additive and a second section that contains additive.

As mentioned, typically, the additive is a liquid and the precise volume of liquid contained in the chamber 130 in the second section will vary depending upon the application and more particularly, depending upon what volume of the unit dose or additive is to be delivered to the sealed container 200 (blood tube or Vacutainer®). For example and in one exemplary application, the unit dose or additive has a volume of between about 50 μL and about 500 μL. However, it will be appreciated that this volume is merely exemplary and that the volume of the chamber 130 can be tailored to any particular application. For example, the housing 110 and the corresponding chamber 130 can be constructed to be fairly small when the additive to be discharged is on the lower end of the scale and conversely, when the additive volume is on the higher end of the scale, the housing 110 and the chamber 130 will likewise have a greater volume.

Since at least one end of the piston 122 has to sealingly engage the wall of the chamber 130 so as to fluidly separate the first and second sections of the chamber 130, the second end 126 of the piston 122 that is contained within the chamber 130, a seal 140 is formed and interacts and engages an inner surface of the chamber 130 to eliminate flow of air or liquid between the piston 122 and the housing chamber 130 (and likewise between the first and second sections of the chamber 130). The seal 140 is preferably formed of a polymeric material that seals against the inner surface of the chamber 130, while still permitting axial movement of the piston 122 within the chamber 130 against the inner surface thereof. It will be understood that the sealing nature and the material construction of the seal 140 causes the piston 122 to be frictionally held along the inner surface of the chamber 130; however, when a force is applied to the piston 122 that is sufficient to overcome the surface tension and frictional force of the seal 140, the piston 122 can be slidingly moved along the inner surface within the chamber 130 as to vary the relative volumes of the first and second sections of the chamber 130.

Depending upon the position of the piston 122 in the chamber 130, the first end 124 of the piston 122 can either be contained completely within the chamber 130 or the first end 124 can be outside of the piston 122. For example, the first end 124 of the piston 122 is shown lying outside of the housing 110 in FIG. 1; however, this is merely one embodiment in which a flange 125 or the like can be formed thereat and has dimensions greater than the dimensions of the chamber 130 so as to limit the degree of travel of the piston 122 in one axial direction since the first flange 125 acts as a stop when it contacts the top face 114. If a flange 125 is provided, the length of the piston 122 should be such that when the piston 122 is in the fully retracted position and the flange 125 seats against the top face 114, the second end 126, and thus the seal 140, is at the complete opposite end of the chamber 130. In other words, when the seal 140 is in this position, the seal 140 does not divide the chamber 130 into two sections since there is only the first section that is defined and conversely, the second section can hold no volume of liquid.

The housing 110 also includes a connector section 140 that is in selective fluid communication with the chamber 130 and is constructed to readily mate with an available conventional connector 300 that is constructed to connect to a vacuum sample tube 200. More specifically, a conduit 150 of small dimension fluidly connects the chamber 130 to the connector section 140. In other words, the dimensions of the conduit 150 are less than the dimensions of the chamber 130 and the connector section 140. The conduit 150 has dimensions such that it functions like an open needle lumen in a syringe that is in fluid communication with the fluid carrying barrel. Just as the fluid in the barrel of a syringe does not flow out through the lumen, the liquid contained in the chamber 130 does not flow out through conduit 150 and through the larger dimensioned connector section 140 due to the pressure differences between the interior of the chamber 130 and outside of the device 100.

Typically, the connector 300 is used to puncture a stopper 220 that seals the container 200 and maintains the vacuum therein. The connector 300 also thus acts to couple the device 100 to the container or tube 200. Depending upon the type of connector 300, the connector section 140 can be tailored so as to permit the two to sealingly mate together. For example, the connector section 140 and the connector 300 can have complementary threads or one of the members can be a female member, while the other member can be a male member, so as to permit a sliding frictional fit therebetween.

The connector 300 also has some means or element 310 that selectively punctures the stopper 220. The element 310 thus is sharp enough to puncture the stopper 220 and it also serves to provide an entrance or pathway to inside of the container or tube 200. For example, the element 310 is typically in the form of a sharp lumen or needle that has a bore formed therethrough that acts as a conduit for carrying fluid. In the illustrated embodiment, the connector 300 has a housing 320 that is constructed and dimensioned to fit over and preferably sealingly mate with the stopper 220 and the open end of the container or tube 200. The element 310 complements the housing 320 and includes a first end 312 that functions as a connector end and an opposing second end 314 that is sharp and constructed to puncture the stopper 220. A bore 316 extends from the first end 312 to the second end 314 so as to permit fluid to be carried through the connector 300 from one end to the other end.

In one embodiment, the connector 300 is of a screw type where the element 310 threadingly mates with the stationary housing 320 so as to permit the element 310 to be moved both towards and away from the stopper 220 so as to allow the needle end 314 to be driven into and through the stopper 220 so that at least the distal end of the needle end 314 is disposed within and in communication with the interior of the container or tube 200. In this embodiment, complementary threads 330 are formed as part of the housing 320 and the element 310 so as to permit the element 310 to threadingly mate and be advanced and retracted relative to the stationary housing 320.

In conventional practice, the first end 312 (connector end) mates with a conduit, such as an IV tube, or the like or even a syringe, ("blood carrying element") so long as this element carries blood to the container 200 through the connector 300 when it mates properly with the container 200. Since the vacuum can not be exhausted by accident and since the vacuum is the means of drawing the liquid (blood) into the container, the blood carrying member is mated first to the first end 312 and then the second end 314 of the connector element 310 pierces the stopper 310 so as to place the second end 314 in communication with the interior of the tube 200. Since the interior of the tube 200 is under vacuum, the bore 316 is exposed to the vacuum, as well as the blood carrying member, and it is the vacuum that acts as the means for drawing the liquid (blood) through the blood carrying member and into the container or tube 200, which is thereby filled with the liquid without accidentally breaking the vacuum or removal of the stopper 220.

However, this conventional arrangement between the blood carrying member, the connector 300 and the tube 200 does suffer from the shortcomings noted previously herein. In particular, the additive package that is contained within the tube 200 can not be tailored or altered from what is provided to the consumer by the tube manufacturer. Since, the stopper 220 can not be removed from the tube 200, the additive package is fixed from the beginning before the blood is introduced into the tube 200.

In direct contrast, the present device 100 provides a means for accurately delivering a unit dose of an additive or another liquid to the container or tube 200. Preferably, the apparatus 100 also includes a cover or the like 160 that mates with the housing 110 and at least encloses the top face 114 of the housing 110. It will be appreciated that the cover 160 illustrated in FIG. 1 is a hollow enclosure that is open at one end (along one face) for receiving the housing 110. The inner diameter of the cover 160 is therefore selected to be slightly greater than or equal to the outer diameter of the housing 110 so as to provide a frictional fit between the cover 160 and the housing 110. It will be appreciated that another type of fit, such as a mechanical or adhesive bond, can be formed between the housing 110 and the cover 160.

In the illustrated embodiment, both the cover 160 and the housing 110 have a cylindrical shape; however, other shapes are possible. The cover 160 is designed to be placed over the housing 110 to eliminate any disturbance of the piston mechanism 120 which might displace fluid inadvertently. The cover 160 also has a vent or port 162 formed as a part thereof. The vent or port 162 can be formed in either the side face or the top face of the cover 160 and serves as an air vent that permit air to flow into the interior of the cover 160 and thus to the housing 110. It will further be appreciated that the cover 160 is preferably designed to be permanently coupled to the housing 110 such that the two are not easily separable from one another. However, the two can be constructed so that the two can be separated from one another.

In the embodiment where the first end 124 of the piston 122 is a flange 125 that lies outside the top face of the housing 110, the distance between the top face of the housing 110 and the top face of the cover 160 is selected so that the axial travel of the piston 122 is accommodated. In other words, the distance must be selected so that when the piston 122 is in its fully extended position, the first end 124 of the piston 122 is close to but not restricted by the top face of the cover 160.

The operation of the device 100 will now be described as well as a method or customizing or tailoring the additive package that is contained in the container or tube 200. First, the container or tube 200 is supplied as only a vacuum sealed tube that is free of any additive or the like. As previously mentioned, the stopper 220 can not be removed from the container or tube 200 during the process of adding, by means of the vacuum, a liquid (blood and/or an additive) to the interior of the tube 200. The present fluid delivery device 100 allows this to be accomplished since it is constructed to sealingly mate with the connector 300, whereby a stored liquid can be delivered from the chamber 130 of the device 100 through the connector 300 and then into the tube 200 without disruption of the vacuum and actually by means of the vacuum, which serves to draw the liquid into the container 200, as described below.

The device 100 is selected so that its chamber 130 is of sufficient volume to receive and hold the liquid (e.g., additive) that is to added to the interior of the tube 200. As mentioned earlier, the volume of the dose of liquid that is to be delivered to the interior of the tube 200 as an additive or the like can vary depending upon what is the precise application for the tube 200. In one embodiment, the liquid is an additive to be delivered to the empty tube 200 for later mixing with the blood as a particular experiment or blood analysis is conducted and the additive has a volume of between about 50 μL to about 500 μL. However, this is merely an exemplary range and the volume can equally fall below or above this range.

After selecting a device 100 that has the correct or desired volume capacity in the chamber 130, the device 100 is then injected with the unit dose of liquid (e.g., additive) that is to be later delivered to the interior of the tube 200 by means of the vacuum. The chamber 130 can be filled with the unit dose of liquid in the follow manner. A syringe or other type of injector 101 is prepared so that it carries the unit dose of liquid. In the case of using a syringe 101, the lumen or needle of the syringe is placed in contact with a supply of the additive and then the plunger thereof is manipulated so that liquid is drawn up into the barrel of the syringe. The amount that is drawn up from the supply into the barrel should equal or be slightly greater than the volume of the unit dose of liquid that is to be delivered to the tube 200.

The syringe or injector 101 is then mated with the connector section 140 of the housing 110 so that the device 100 and the syringe or injector are fluidly and sealingly connected to one another to permit transfer of the unit dose of liquid from the barrel of the syringe or injector to the chamber 130. For example, the two members can be threadingly mated with one another. To inject the unit dose of liquid into the chamber 130, the syringe or injector is actuated, e.g., by moving the plunger, to discharge the unit dose from the barrel into the connector section 140 and then into the conduit 150 and then finally into the chamber 130. Since pressure is applied and generated during the discharge and delivery of the unit dose to the chamber 130, this pressure is applied to the piston 122 and since this pressure generated is greater than the forces that hold the seal 140 and piston 122 for that matter in place in the chamber 130, the piston 122 is axially displaced an amount that permits the unit dose of liquid to be received in the chamber 130. In other words, the liquid, under force (pressure), is injected through the conduit 150 into the chamber 130 where is contained in the second section of the housing 110 after the piston 122 is axially displaced a sufficient distance. The vent or port 162 in the cover 160 permits the piston 122 to move when pressure is exerted on it by the injected unit dose of liquid since air is vented from within the housing 110. After injecting the liquid and detaching the syringe or injector from the connector section 140, he injected unit dose of liquid is contained within the chamber 130 between the seal 140 and the conduit 150 and it will be appreciated that the liquid can not flow out of the chamber 130 through the conduit 150 as a result of the conduit 150 having such small dimensions such that in order for the liquid to be discharged through the conduit 150, a sizeable applied force or pressure difference is needed and is absent during normal operation of the apparatus. As a result, the unit dose of liquid will remain contained within the chamber 130.

The filled device 100 is then coupled to the connector 300 by mating the element 310 and more particularly, the first end 312 thereof, to the connector section 140. For example, when both the first end 312 and the connector section 140 have threads, the two are threadingly mated with one another. This results in the bore 316 being axially aligned with the conduit 150 so as to selectively place the chamber 130 in fluid communication with the element 310. Once again, the unit dose of liquid still remains securely held within the chamber 130.

The combined, joined device 100 and connector 300 are then brought into contact with and exposed to the interior vacuum of the tube 200. More specifically, the housing 320 of the connector 300 is aligned with the sealed open end of the tube 200 and in this position, the second sharp end 314 of the element 310 faces the stopper 220. Either the joined apparatus 100 and connector 300 are rapidly moved towards the stopper 220 or the test tube 200 is rapidly moved towards the apparatus/connector such that the sharp second end 314 of the element 310 pierces the stopper 220 and is driven further into and through the stopper 220 until the second end 314 enters the interior of the tube 200 underneath the stopper 220 such that the bore 316 is placed in fluid communication with the interior of the tube 200.

As soon as the element 310 enters the interior of the tube 200, the bore 316 is exposed to the vacuum contained in the tube 200 and as a result, the chamber 130 itself is exposed to the vacuum. Since the vacuum represents an area of negative pressure compared to the pressure in the chamber 130, the conduit 150, and the connector section 140, the unit dose of liquid contained in the chamber 130 is drawn from the chamber 130 into the conduit 150 and then through the bore 316 and ultimately into the interior of the tube 200. However, the seal 140 in the chamber 130 prevents the entire vacuum from being exhausted and the vent or port 162 of the cover 160 permits such drawing of the liquid under action of the vacuum contained in the tube 200. The vacuum is not significantly exhausted since the amount of vacuum that is required to draw the small volume of additive from the chamber 130 is very little and therefore, after removal of the connector 300 from the tube 200, the tube 200 still contains enough vacuum to later draw blood into the tube 200.

After all of the unit dose of liquid (additive) is delivered by means of the vacuum to the tube 200, the combined apparatus 100/connector 300 are removed from the tube 200 by pulling these members apart from the tube 200 such that the stopper 220 reseals itself and the vacuum is preserved in the tube 200. It is important that the connector 300 is not left in place on the stopper 220, while the device 100 is removed therefrom since this would result in the interior of the tube 200 being freely exposed to the surrounding atmosphere through the bore 316, whereby the vacuum will be exhausted. This is not acceptable since the vacuum is later needed to draw blood into the tube 200.

The foregoing steps and the construction of the device 100 permit the liquid to be added to the tube 200 without the removal of the stopper 220 and therefore, the vacuum remains in the tube 200 which is otherwise not contaminated. It will therefore be appreciated that the device 100 permits a preselected liquid or a mixture of liquids to be added to the tube 200. This is desirable since it permits the user to tailor what additive is added to the tube 200 as well as what the characteristics of the additive are, such as volume, concentration, etc.

With the desired additive or additive package in place within the still vacuum sealed tube 200, the vacuum tube 200 can then be coupled to a blood carrying member, such as an IV tube, that is connected to a blood source, such as the human body. This is typically done using the connector 300 in a process similar to the one described above in that the blood carrying member is first connected to the connector 300 and then the combined blood carrying member and connector are fluidly connected to and exposed to the vacuum of the sealed tube 200 as by piercing the stopper 220 with the element 310. As soon as the element 310 pierces the stopper 220 and exposes the bore 316 to the vacuum, the blood itself is exposed to the vacuum (strong negative pressure) in the tube 200 and the serves to draw the blood from and through the blood carrying member and the connector 300 and into the interior of the tube 200 due to the pressure differential in the tube 200 and the location of where the blood is contained. As the blood is drawn into the tube 200, the vacuum is continuously exhausted; however, the vacuum strength is initially set so that it is more than enough to draw the desired amount of blood into the tube 200.

As with the removal of the combined device 100/connector 300, the combined blood carrying member/connector 300 are removed as a pair as opposed to first removing the blood carrying member from the connector 300 to ensure that the vacuum, if any remains, is still in place. Moreover, even if it is of no or little consequence to preserve the vacuum in the tube after delivery of the blood, it still is advisable not to first remove the blood carrying member from the connector 300 since this would leave the element open and exposed to the environment at one end, while the opposite end is still within the interior of the tube 200. As a result, foreign matter could travel through the open bore 316 and into the interior of the tube 200, thereby contaminating the blood. Thus, it is always advisable to first disconnect the connector 300 from the stopper 220 so as to reseal the stopper 220 and preserve the integrity of the liquid within the tube 200 as well as maintain any vacuum, if desired.

Once the desired volume of blood is received within the tube 200, the user then processes the blood using conventional protocol. More specifically, depending upon what type of additive(s) are included in the tube 200, the user conducts a series of inversions of the tube 200 to ensure that the blood and the additive(s) in the tube 200 properly mix with one another. A proper mixing is necessary to ensure that the results obtained are reliable. The user will then observe the blood for any changes in its appearance that represents an indication of the presence or absence of a condition that is being tested or the user can conduct further testing by removing a sample of mixed blood and then running additional tests, etc.

Figure 7:
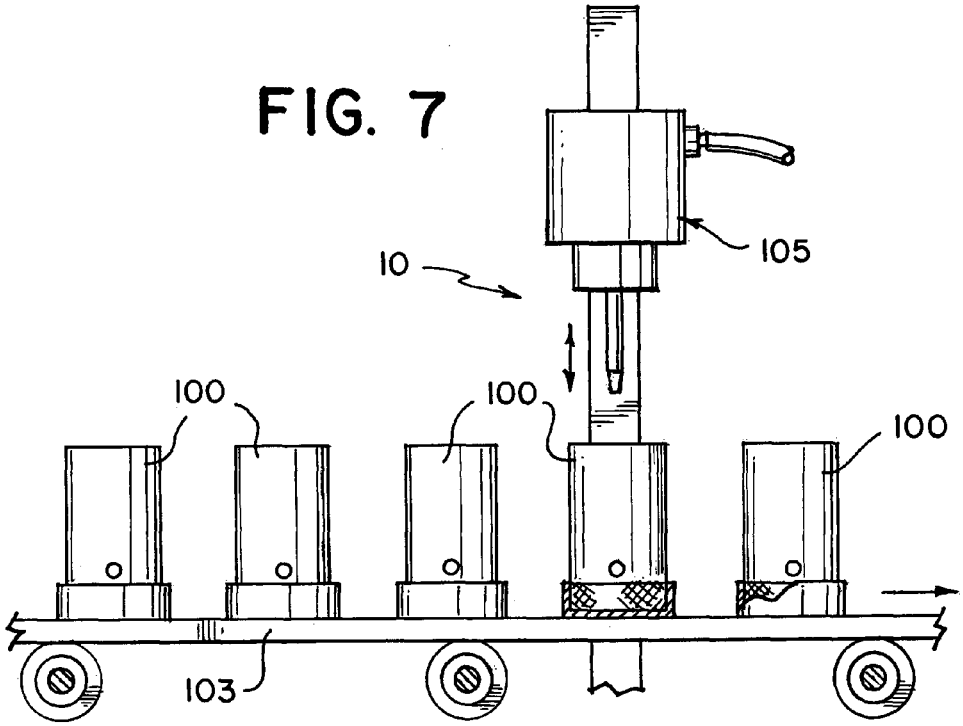
FIG. 7 is a side elevation view of an automated additive/reactant delivery system for delivering a predetermined volume of the additive to a series of additive/reactant delivery devices.

It will further be appreciated that the device 100 can be part of an overall automated system 10 that includes a station for preparing, in series, a number of apparatuses 100 including the injection of a predetermined amount of liquid into the chamber 130 as shown in FIG. 7. The amount that is injected into the chamber 130 corresponds to the amount of liquid that is to be discharged into the tube 200. It will be understood that the apparatus 100 is advantageously constructed such that it is has a simply yet effective design, it is easily integratable with existing blood collection systems; reliably delivers a defined quantity of fluid; consistently and reliably delivers the same quantity of fluid to each blood sample tube; and can easily and reliably be filled with a defined quantity of liquid.

In the automated system 10, a series of devices 100, in loose or bandoliered form, can be automatically transferred by a drive system 103 (e.g., conveyor belt) or the like from one station to another station. One of the stations is a filling station where a predetermined volume ("the unit dose") of dilutant is automatically filled into the device 100 in the manner previously described herein. For example, the filling station can include an injector 105 that mates with the connection section 140 and then, in an automated fashion, injects the unit dose of dilutant into the chamber 130 as by using a syringe injector 101 that delivers the unit dose under pressure to the chamber 130 and consequently causes axial movement of the piston 122 to accommodate the unit dose of dilutant. Preferably, all of the automated components are integrated with one another via a master controller that is programmable and permits the user to input and vary the type of dilutant and the volume of the unit dose. For example, the user can instruct the automated system 10 to produce a first number of tubes 200 that contain additive A in a volume B for each tube and then secondly, the system 10 is programmed to produce a second number of tubes 200 that contain additive B in a volume C. The reader will appreciate that the automated system 10 can be programmed and run so that as little as one tube 200 is prepared with an additive, while equally, the system 10 can be run so that a large number of tubes can be created that contain an additive.

Figure 5:
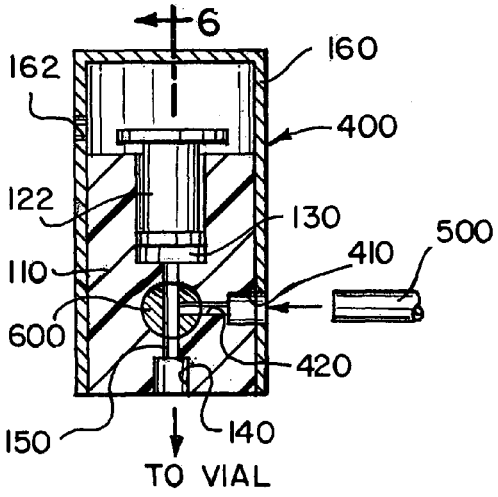
FIG. 5 is a cross-sectional view of a additive/reactant delivery device according to a second embodiment.
Figure 6:
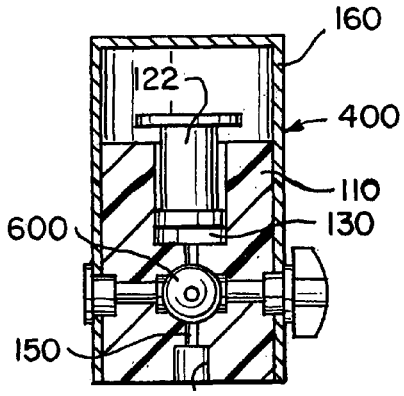
FIG. 6 is a cross-sectional view taken along the line 6-6 of FIG. 5.

FIGS. 5-6 illustrate a controlled dilutant delivery system that includes a fluid delivery device 400 according to a second embodiment. The device 400 is similar to the apparatus 100 and therefore like elements are numbered alike; however, the apparatus 400 includes permits connection directly to the blood carrying member as well as has a valve mechanism to permit selection as to whether the blood carrying line or the chamber 130 in the device 400 is open and exposed to the vacuum in the tube 200. In this manner, the device 400 provides integrated functionality and permits the user to select which line is in fluid communication with the vacuum and thus, which liquid is drawn into the tube 200 (FIG. 1) by means of the vacuum.

The device 400 includes the housing 110 defining the chamber 130 as well as the conduit 150 and first connector section 140 and cover 160. The main difference between the devices 100 and 400 is that the device 400 includes a second connector section 410 that is constructed to be sealingly mate with a blood carrying member 500, such as an IV tube, that carries blood from a source, such as a patient, to the tube 200. The second connector section 410 can include threads or it can be bore that acts as a female member in a frictional male/female fit.

The first and second connector sections 140, 410 are spaced from one another so that the elements that each respectively receives are isolated and separated from one another. In the illustrated embodiment, the first and second connector sections 140, 410 are separated by 90 degrees from one another with the first connector section 140 being formed in the bottom of the housing 110 and the second connector section 410 being formed in the side thereof. The sealing means that are incorporated into the first and second connector sections 140, 410 can be the same or they can be different. For example and according to one embodiment, the second connector section 410 has threads that mate with complementary threads formed as part of the blood carrying member 500. However, the attachment between the blood carrying member 500 and the housing 110 can be by means of a frictional or mechanical fit as by press fitting of the blood carrying member 500 within the second connector section 410.

The second connector section 410 is in fluid communication with a side conduit 420 that leads from the second connector section 410 to the main conduit 150 that is formed between the chamber 130 and the first connector section 140. The side conduit 420 thus serves to provide a fluid path for liquid (blood) that is flowing within the blood carrying member 500 to enter the main conduit 150. The apparatus 400 also includes a valve mechanism 600 for selectively and controllably isolating and connecting either the chamber 130 so as to deliver the dilutant (additive) to the tube 200 or for connecting the blood carrying member 500 to the tube 200 so as to deliver blood to the tube 200. The valve mechanism 600 is thus of the type that is simple and easy to operate yet effective and can easily be operated to permit the user to change what element is fluidly connected to the interior of the tube 200.

In one embodiment, the valve mechanism 600 is a three-way stopcock valve mechanism that is incorporated within the main conduit 150 between the first connector section 140 and the chamber 130. One element of the stopcock valve 600 connects to or is associated with the delivery system chamber 130, while another element connects to or is associated with the connector section 140 and therefore, connects to the sample tube 200 through a needle insertion system. A third element of the stopcock valve 600 allows connection with the blood carrying member 500 from the patient. The stopcock valve 600 is constructed so that one of the chamber 130 and the blood carrying member 500 is fluidly connected to the tube 200 or alternatively, both the chamber 130 and the blood carrying member 500 are brought off line and the apparatus 400 is placed in a closed, off position.

First, a predefined unit dose of liquid (additive(s)) is injected into the chamber 130 as described in detail hereinbefore. For example, the unit dose can be injected using a syringe or the like. Once the unit dose of liquid is contained in the chamber 130 and the piston 122 has been displaced a distance, both the connector 300 and the blood carrying member 500 are sealingly connected to the apparatus 400 by first sealingly connecting the element 310 to the first connector section 140 as well as sealingly connecting the blood carrying member 500 to the second connector section 410. The valve mechanism 600 is then positioned, as by rotating the valve, such that the chamber 130 is in fluid communication with the first connector section 140 through the main conduit 150 (isolation of the chamber 130). As previously mentioned, due to the differences in pressure, the liquid in the chamber 130 will not flow out of the chamber through the main conduit 150. The connector 300 and the tube 200 (FIG. 4A) are then mated together, using the techniques previously mentioned, resulting in the second end 314 of the element 310 piercing the stopper 220 and entering the interior of the tube 200. Once the second end 314 enters the interior of the tube 200, the bore 316 and the device 400, including chamber 130 thereof, are exposed to the vacuum in the tube 200. Due to the presence of negative pressure in the tube 200 and differences in pressure, the liquid in the chamber 130 is drawn through the conduit 150 and through the bore 316 into the interior of the tube 200. In other words, the vacuum effectively draws the unit dose of liquid into the tube 200.

After the unit dose of liquid has been delivered to the tube 200, the stopcock valve 600 is then positioned, as by rotating it, so that the side conduit 420 is placed in fluid connection with the main conduit 150 and the chamber 130 is cut off from the tube 200. This results in the blood carrying member 500 being exposed to the vacuum in the tube 200 (isolation of the blood carrying member 500) and the blood is drawn through device 400 and the connector 300 into the interior of the tube 200. The first step of drawing the additive(s) into the tube 200 only exhausts a small fraction of the vacuum contained in the tube 200 and thus, there is still plenty of vacuum strength to draw the necessary amount of blood into the interior of the tube 200. After a predetermined amount of blood is drawn into the tube 200, the tube 200 is then isolated from the other parts as by first positioning the stopcock valve 600 to a closed position where the tube 200 is isolated or the element 310 can be removed from the stopper 220, thereby isolating the tube 200.

The design of the device 400 allows increased convenience and less manipulation during the procedure of adding dilutant (additive) and drawing a blood sample into the tube 200.

It will be appreciated that the present invention overcomes the disadvantages associated with the prior art and provides a device that permits the user to customize the exact dilutant (additive) that is to be delivered to the tube for mixing with blood and therefore, the user has a great deal of choices beyond the prepared additive tubes (e.g., Vacutainer®) that are commercially available.

Figure 8:
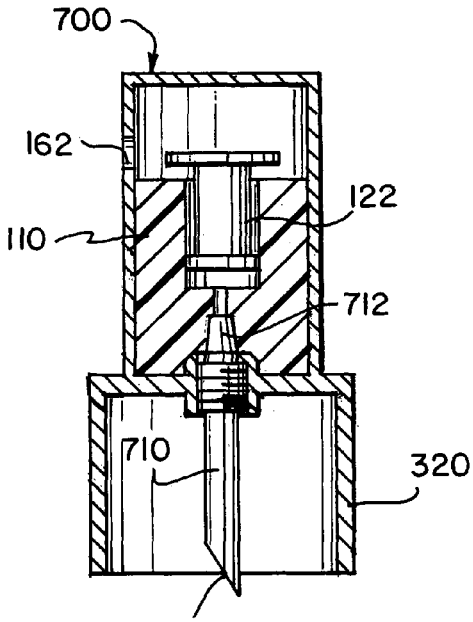
FIG. 8 is a cross-sectional view of a delivery device according to an alternative embodiment.

With reference to FIG. 8, a delivery device 700 according to another embodiment is illustrated. The device 700 is similar to the device 100 and therefore like components are numbered alike. The device 700 is designed so as to eliminate the need for the connector 300 in that the device 700 can detachably mate directly with the container/tube 200 and has a feature formed as a part thereof that can pierce the stopper 220 and expose the chamber 130 to the vacuum. More specifically, the housing 110 has a piercing element 710 directly formed as a part thereof for piercing the stopper 220 and exposing the chamber 130 to the vacuum. In this embodiment, the cover 160 and the housing 320 are integral with one another; however, the two can be separate members to permit the insertion and loading of the piston 122 or the like into the chamber 130 prior to use of the device. In the case where the two are separate from one another, the cover 160 can be attached to the housing 320 using any conventional means, including but not limited to a snap-fit or frictional means, as previously shown (FIG. 1).

The piercing element 710 is a hollow element that has a first end 712 that is integral with the housing 110 (the bottom side thereof) as well as a second end 714 that is sharp and is designed to pierce and pass through the stopper 220. In the illustrated embodiment, the housing 320 is an integral extension of the housing 110, while the piercing element 710 is shown as being detachable from the housing 320 in that it threadingly mates with the housing 320; however, it is be understood that the piercing element 710 can instead be integrally formed with the housing 320. When the housing 320 is an integral extension of the housing 110, the cover 160 can be a separate part that is coupled to the combined housings 320, 110 after the piston 122 or the like is inserted into the chamber 130. Once again, the means for coupling the cover 160 to the combined housings can be any number of conventional means, including but not limited to snap-fit means, a frictional fit, or even use of an adhesive, etc.

The hollow piercing element 710 is in fluid communication with and represents an axial extension of the conduit 150 such that liquid or reactant material can travel directly through the piercing element 710 and either into or out of the chamber 130. This embodiment is simpler than the one shown in FIG. 1 since it does not require the use of an additional separate connector part, namely, the connector 300 to deliver the additive to the container 200.

The device 700 can be loaded with additive in any number of different ways, including the provision of a filling reservoir with a rubber stopper or other puncturable material through which the piercing element 710 of the device 700 can be placed and fluid under pressure in the filling system can be pumped into the device 700. The device 700 can then removed and stored for use at a later time, along with the filling equipment. After loading the additive into the chamber 130, the device 700 is used in the same manner as the device 100 in that it is brought into contact with the tube 200 by puncturing the stopper 220 with the piercing element 710 resulting in the chamber 130 being exposed to the vacuum, which draws the additive out from the chamber 130. The device 700 is then separated from the tube 200 and blood is then drawn into the container/tube 200 using conventional techniques. In the embodiment where the piercing element 710 is detachable from the housing 320, the filling or loading of the chamber 130 occurs by detaching the piercing element from the housing 320 and then placing the injector into the conduit 150 to inject the additive under pressure.

Figure 9:
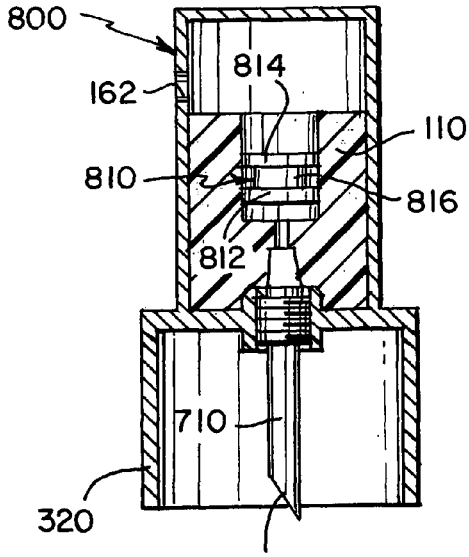
FIG. 9 is a cross-sectional view of a delivery device according to another alternative embodiment.

FIG. 9 illustrates yet another embodiment of the present invention that is similar to both the embodiments of FIGS. 1 and 8. More specifically, FIG. 9 illustrates a delivery device 800 that can receive and hold a liquid or other reactant material, such as a powder or gel. Instead of having a piston 122, the device 800 includes a slideable disc 810 that seals along an inner surface that defines the chamber 130, but at the same time is slidingly moveable therealong under an applied force, e.g., positive or negative pressure. The disc 810 thus maintains an airtight seal with the wall of the chamber 130 and can be formed of a number of different materials, including a polymeric material. As with the seal 140 of the piston 122 in the embodiment of FIG. 1, the disc 810 divides the chamber 130 into two subchambers, one of which receives the additive. The operation of the device 800 is the same as the operation of device 700 in that the additive is injected into the chamber 130 and then the device 800 is coupled to the tube 200 so that the piercing element 710 pierces the stopper 220 causing the chamber 130 and the disc 810 to be exposed to the vacuum resulting in the additive being drawn from the chamber 130 and into the tube 200.

To provide structural rigidity and robustness, the disc 810 is formed of a first disc 812 and a second disc 814 spaced therefrom with a connecting section 816 formed therebetween and connecting the two discs 812, 814.

Once again, it will be understood that the cover 160 in the embodiments of FIGS. 8 and 9 can be integral with the housing 110 or it can be a separate part that is coupled to the housing as shown in the earlier embodiments. In the case where it is integral, the piston 122 or the like could be properly positioned in a mold and then the integral structure (integral cover and housing) is formed around the piston (i.e., in-situ molding). Alternatively, the housings 320, 110 can be made integral as by molding on-situ and then the piston 122 or the like is placed in the chamber 130 and then the cover 160 is coupled to the combined housings.

It will once again be appreciated that the delivery devices disclosed herein are not limited to liquid type additives but also can be used for other reactant materials (powder, gels, etc.) and the use of the present delivery devices is not limited to blood related analysis applications. In other words, the technology is applicable to not only preparing tubes for the analysis of a variety of standard blood tests but is also applicable for more advanced analyses, such as proteonomics and genomics. In that regard, these types of analyses may require complex reactant mixtures and the constituents of these reactant mixture may frequently require revision. The ability to uniformly and easily load tubes with a wide variety of reactant mixtures for various applications and analyses has merit especially for more complex and sophisticated tests.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. An apparatus for use in a system for controlled delivery of a predetermined volume of a reactant, such as a liquid or solid, to a vacuum sealed container comprising:

a housing including a chamber defined therein for holding the predetermined volume of reactant and a first connector section for providing a sealed coupling to the container, the first connector section being an opening formed in the housing and open along one face of the housing that faces the container when the apparatus is coupled to the container, the housing being a single structure that includes the first connector section, the chamber and the conduit; and a piston axially moveable within the chamber in response to an applied force, the piston having one end that seals against an inner surface that defines the chamber with the reactant being contained and held between the one end of the piston and a reduced diameter conduit that fluidly connects the chamber with the connector section;

a cover that has an open first end and an opposing closed end, wherein the cover receives and at least partially surrounds the housing and completely surrounds the entire piston so that any contact with the piston is prevented, the cover having a vent port formed therein to permit passage of air into an enclosed chamber that contains a flange of the piston, wherein the piston including the flange is completely enclosed by the closed end of the cover so as to prevent access to the flange;

wherein sides and an end of the chamber are defined by walls of the housing and the conduit comprises a fixed channel integrally formed within the housing, wherein the apparatus is constructed so that once the conduit and chamber are exposed to the vacuum of the container by passing a piercing member through a stopper of the container and locating a connector end of the piercing member within the first connector section, wherein the conduit has a diameter less than a diameter of the first connector section resulting in a shoulder formed therebetween that limits travel of the connector end of the piercing member, the reactant is drawn from the chamber through the conduit and into an interior of the container without releasing a vacuum seal between the stopper and container, the chamber and conduit being formed so that the additive is self-contained within the delivery device prior to the coupling of the delivery device with another component.

2. The apparatus of claim 1, wherein the chamber, the reduced diameter conduit and the first connector section are axially aligned with each other.

3. The apparatus of claim 1, wherein the piston has an elongated shaft with the one end in the form of the seal having a greater diameter than a diameter of the shaft and in facing relationship with the reduced diameter conduit.

4. An apparatus for use in a system for controlled delivery of a predetermined volume of one or more additives to a vacuum sealed blood collection container comprising: a housing including a chamber defined therein for holding the predetermined volume of the additive and a first connector section in fluid communication with the chamber by means of a conduit of reduced diameter that fluidly connects a first end of the chamber to the first connector section which is in the form of an opening formed in the housing, the conduit being integrally formed in the housing at a fixed location, a piston axially moveable within the chamber between a first position and a second position in response to an applied force, the piston being offset and separate from the conduit integrally formed in the housing, the piston having one end that seals against an inner wall of the chamber, wherein in the first position, the piston is proximate the first end of the chamber which is empty and when positive pressure is applied to the piston during loading of the additive, the piston moves to the second position, with the additive contained between the one end of the piston and the conduit; and a cover at least partially surrounding the housing and containing a vent port to permit passage of air to the housing, the cover completely enclosing the entire piston structure including a flange formed at one end thereof and preventing access to the entire piston including the flange while providing a sufficient space to allow for movement of the piston, wherein the vent port forms an entrance into an enclosed chamber that contains the free end of the piston; wherein the apparatus is constructed so that once the chamber is exposed to the vacuum of the blood collection container, the piston returns to the first position and the additive is drawn from the chamber though the conduit and into an interior of the container without releasing a vacuum seal between the stopper and container, whereby the blood collection container can subsequently be used to draw blood under vacuum to mix with the additive and permit scientific analysis thereof.

5. A system for controlled delivery of a predetermined volume of reactant to a vacuum sealed container comprising: an apparatus including a housing having a chamber defined therein for holding the predetermined volume of reactant and a first connector section in select fluid communication with the chamber via a main conduit having a reduced cross-section, the first connector section being an opening formed in the housing that is open along one face of the housing and has a diameter that is greater than a diameter of the main conduit so as to form a shoulder therebetween, wherein the chamber, main conduit and first connector section are formed in series within the housing with one end of the main conduit interfacing with the first connector section and the other end of the main conduit interfacing with the chamber, the first connector section being in direct fluid communication with the main conduit and arranged relative thereto to cause fluid to travel from the main conduit into the first connector section, the apparatus including a piston that is axially moveable within the chamber in response to an applied force, with one end of the piston sealing against an inner surface that defines the chamber; and a connector that can be detachably attached to the connector section of the apparatus, the connector having a hollow piercing element that has a first end to sealingly mate with the first connector section of the apparatus so as to axially align and fluid connect the main conduit with the hollow piercing element, and a sharp second end for piercing through a stopper of the vacuum sealed container, the hollow piercing element thus being directly in contact with both the housing of the apparatus and the container the connector being a separate part from the apparatus to allow the detachable coupling and removal of the apparatus from the connector, the reactant being self-contained within the chamber when the apparatus is separated from the connector; wherein the attached apparatus and connector are constructed to mate with the vacuum sealed tube for delivering the reactant such that the piercing element pierces through the stopper and the second end of the element is in fluid communication with an interior of the container causing the chamber in the apparatus to be exposed to the vacuum resulting in the predetermined volume of reactant being drawn from chamber, flowing through the main conduit and through the first connector section, through the connector and into the container without releasing a vacuum seal that exists between the stopper and container; and a cover that receives and at least partially surrounds the housing and completely surrounds the entire piston structure including a flange so as to prevent access to the entire piston including the flange thereof, the cover having a vent port formed therein to permit passage of air into an enclosed chamber that contains the free end of the piston.

6. The system of claim 5, wherein the chamber, the main conduit and the first connector section are axially aligned with each other.

7. The system of claim 5, wherein the piston has an elongated shaft with the one end in the form of the seal being of a greater diameter than a diameter of the shaft and in facing relationship with the reduced diameter conduit.

8. The system of claim 5, wherein the first end of the piercing element and the connector section of the apparatus include complementary threads to permit the two to be threadingly mated with one another in a sealed manner.

9. The system of claim 5, further including: an automated filling station where a fluid injector is in communication with a programmable controller and a plurality of apparatuses in series are automatically fed at intervals to the fluid injector which has an injector tip that sealingly mates with the connector section of the housing and delivers the predetermined volume of reactant to the chamber before detaching from the first connector section.

10. The system of claim 9, wherein the fluid injector produces a positive pressure when injecting the reactant to cause axial movement of the piston in the chamber, with the reactant being sealingly held within the chamber between the seal of the piston and the main conduit.

11. The system of claim 5, wherein a strength of the vacuum is greater than a force necessary to discharge the reactant from the chamber through the main conduit so as to cause the reactant to be drawn out of the chamber.

12. The system of claim 5, wherein the reactant comprises a liquid additive for mixing with blood to perform a test, the additive having a predetermined volume of between about 50 μL to about 500 μL.

13. The system of claim 5, wherein the reactant is an additive selected from the group consisting of: a liquid additive, a solid powder additive, and a gel additive.

14. A method of delivering an additive to a vacuum sealed blood collection container through a stopper attached thereto without releasing the vacuum comprising the steps of:

providing a fluid delivery device including a housing that includes an open connector section, a reduced diameter conduit, and a chamber defined therein for holding a predetermined volume of additive and a piston that is axially moveable within the chamber in response to an applied force, with one end of the piston sealing against an inner surface that defines the chamber, wherein the piston is completely enclosed within the delivery device, wherein an opposite end of the piston is defined by a flange, and the reduced diameter conduit fluidly connects the connector section to the chamber;

delivering the volume of additive under positive pressure to the chamber causing axial movement of the piston within the chamber to permit the additive to be sealingly and self-contained in the chamber;

providing a cover around the housing of the delivery device, the cover having an air vent and a closed end, wherein the closed end of the cover completely encloses the piston including the flange so as to prevent access to the entire piston including the flange;

attaching a connector to the delivery device, the connector being separate and detachable from the housing and having a hollow piercing element that has a first end to sealingly mate with the delivery device by inserting the first end into the connector section formed within the housing and a sharp second end for piercing through the stopper of the vacuum sealed container, wherein the hollow piercing element is in direct contact with both the housing of the fluid delivery device and the container;

piercing the stopper with second end of the piercing element until the second end enters an interior of the container; and exposing the chamber in the delivery device to the vacuum resulting in the predetermined volume of additive being drawn from the chamber as a result of axial movement of the piston within the chamber due to the piston being exposed to the vacuum through the connector and into the container without releasing a vacuum seal that exists between the stopper and container, thereby permitting blood to be later drawn into the container under action of the remaining vacuum, wherein the additive remains self-contained in the chamber prior to attachment of the connector to the delivery device when the delivery device is spaced and separate from the connector.

15. The method of claim 14 wherein the connector section that sealingly mates with the first end of the piercing element and wherein the step of delivering the volume of additive under positive pressure to the chamber comprises the steps of: sealingly connecting the connector section to an automated, programmable injector; and operating the injector to deliver, under positive pressure, the predetermined volume of additive to the chamber, the injected additive being held in the chamber by a pressure differential even before the delivery device is connected to the connector and when the connector section remains open.

16. The method of claim 14, wherein the step of exposing the chamber in the delivery device to the vacuum comprises the steps of: directing the combined delivery device/connector into contact with the container such that the piercing element punctures the stopper; and directing the second end of the piercing element into the interior of the container.

17. The method of claim 14, further including the steps of: attaching a first end of a blood carrying member to the connector, the other end of the member being in communication with a source of blood; piercing the stopper with second end of the piercing element until the second end enters an interior of the container; and exposing the blood carrying member to the vacuum resulting in a predetermined volume of blood being drawn from the blood carrying member through the connector and into the container without releasing the vacuum seal.

18. An apparatus for use in a system for controlled delivery of a predetermined volume of one or more additives to a vacuum sealed collection container comprising: a housing including a chamber defined therein for holding the predetermined volume of the additive and a first connector section in fluid communication with the chamber by means of a conduit of reduced diameter that fluidly connects a first end of the chamber to the first connector section, the conduit being integrally and fixedly formed in the housing, a sealing member axially moveable within the chamber between a first position and a second position in response to an applied force, the sealing member seals against an inner wall of the chamber and is separate from and offset from the conduit, wherein in the first position, the sealing member is proximate the first end of the chamber which is empty and when positive pressure is applied to the sealing member during loading of the additive, the sealing member moves to the second position, with the additive contained between the sealing member and the conduit; a cover having a closed end, the cover at least partially surrounding the housing and completely containing and surrounding the entire sealing member including a flange at one end thereof so as to prevent access to the flange, wherein a top wall of the cover is spaced a sufficient distance from the flange to allow axial movement of the sealing member within the chamber, and containing a vent port to permit passage of air to the housing; and a hollow piercing element integrally formed with the housing and extending outwardly from one face thereof, the piercing element having a sharp distal end for piercing a stopper associated with the collection container and a bore formed therethrough that is axially aligned with the conduit to permit flow therebetween, the hollow piercing element being in direct contact with the conduit formed in the housing and the collection container; wherein the apparatus is constructed so that once the chamber is exposed to the vacuum of the blood collection container, the sealing member returns to the first position as a result on being drawn to the first position entirely by means of the applied vacuum and the additive is drawn from the chamber through the conduit and into an interior of the container without releasing a vacuum seal between the stopper and container, whereby the blood collection container can subsequently be used to draw blood under vacuum to mix with the additive and permit scientific analysis thereof.

19. The system of claim 18, wherein the sealing member comprises one of a piston having a seal at one end and a polymeric seal disc that can travel axially within the chamber and seals along its peripheral edge to the inner surface of the chamber.

20. The system of claim 18, wherein the additive is selected from the group consisting of: a liquid additive, a solid powder additive, and a gel additive.

21. The system of claim 18, wherein the piercing element is integrally attached at one end to the housing by being molded in-situ with the housing.

* * * * *